US005309874A

United States Patent [19]

Willermet et al.

[11] Patent Number: 5,309,874

[45] Date of Patent: May 10, 1994

[54] POWERTRAIN COMPONENT WITH ADHERENT AMORPHOUS OR NANOCRYSTALLINE CERAMIC COATING SYSTEM

[75] Inventors: Pierre A. Willermet, Livonia; Arup K. Gangopadhyay, Novi, both of Mich.; Michael A. Tamor, Toledo, Ohio; William C. Vassell; Margherita Zanini-Fisher, both of Bloomfield, Mich.

[73] Assignee: Ford Motor Company, Dearborn, Mich.

[21] Appl. No.: 2,190

[22] Filed: Jan. 8, 1993

[51] Int. Cl.[5] ..... F01L 1/16

[52] U.S. Cl. ..... 123/90.51

[58] Field of Search ..... 123/90.48, 90.51

[56] References Cited

U.S. PATENT DOCUMENTS

| | | | |
|---|---|---|---|
| 4,153,017 | 5/1979 | Behnke | 123/90.51 |
| 4,399,168 | 8/1983 | Kullander et al. | 427/255.7 |
| 4,436,775 | 3/1984 | Graham | 427/419.7 |
| 4,461,799 | 7/1984 | Gavrilov et al. | 428/210 |
| 4,492,522 | 1/1985 | Rossmann et al. | 416/241 |
| 4,538,562 | 9/1985 | Matsui et al. | 123/90.51 |
| 4,594,973 | 6/1986 | Allred et al. | 123/90.4 |
| 4,610,896 | 9/1986 | Veltri et al. | 427/140 |
| 4,667,468 | 5/1987 | Hansen | 60/39.6 |
| 4,671,997 | 6/1987 | Galasso et al. | 428/408 |
| 4,774,926 | 10/1988 | Adams | 123/668 |
| 4,782,656 | 11/1988 | Hansen | 60/39.6 |
| 4,800,137 | 1/1989 | Okuno et al. | 428/698 |
| 4,843,040 | 6/1989 | Oda et al. | 501/92 |
| 4,871,266 | 10/1989 | Oda | 384/42 |
| 4,873,150 | 10/1989 | Doi et al. | 123/90.51 |
| 4,902,535 | 2/1990 | Garg et al. | 427/292 |
| 4,909,198 | 3/1990 | Shiraya et al. | 123/90.51 |
| 4,909,230 | 3/1990 | Kawamura | 123/668 |
| 4,919,773 | 4/1990 | Naik | 204/38.4 |
| 4,923,308 | 5/1990 | Watanabe et al. | 374/137 |
| 4,952,715 | 8/1990 | Blum et al. | 556/409 |
| 4,995,281 | 2/1991 | Allor et al. | 123/90.44 |
| 5,008,422 | 4/1991 | Blum et al. | 556/412 |
| 5,040,504 | 8/1991 | Matsuoka | 123/254 |
| 5,055,431 | 10/1991 | Blum et al. | 501/97 |
| 5,128,494 | 7/1992 | Blum | 556/457 |

FOREIGN PATENT DOCUMENTS 0435312 7/1991 European Pat. Off. .

*Primary Examiner*—Willis R. Wolfe
*Assistant Examiner*—Weilun Lo
*Attorney, Agent, or Firm*—Roger L. May; Joseph W. Malleck

[57] ABSTRACT

A powertrain component (10) for use in an internal combustion engine, the powertrain component comprising a coating system including an amorphous or nanocrystalline ceramic film (30). The powertrain component (10) also includes an interlayer (42) formed between the film and the component. The interlayer (42) accommodates stresses engendered by formation of the film (30), and thereby improves adherence of the film (30) to the substrate (10). To enable engineering of desired surface properties, the film (30), the interlayer (42), or both may be provided with a graded composition profile.

18 Claims, 4 Drawing Sheets

POWERTRAIN COMPONENT WITH ADHERENT AMORPHOUS OR NANOCRYSTALLINE CERAMIC COATING SYSTEM

BACKGROUND OF THE INVENTION

1. Field Of The Invention

The present invention relates to a powertrain component for use in an internal combustion engine. More particularly, the invention relates to a component having a hard, wear resistant amorphous or nanocrystalline ceramic coating system of constant, abruptly varying or continuously varying composition deposited thereon.

2. Related Art Statement

The selection of materials from which internal combustion engines and associated machinery are fabricated is subject to constraints which grow more stringent with demands for lower weight, increased efficiency, reduced internal friction and reduced emissions. These factors are strongly synergistic. For example, reduction in the mass of a moving component reduces total vehicle weight, allows higher engine speeds and increased specific power output while simultaneously reducing the forces and therefore the friction associated with guiding its motion, so reducing vibration and stress on other components. This in turn allows further weight reductions elsewhere. Also, materials with sufficiently low friction and wear in dry sliding need not be lubricated at all, thus eliminating the parasitic power loss required for pumping oil, further increasing engine efficiency.

Development of new powertrain materials requires simultaneous control of bulk properties such as weight, strength and fatigue resistance, and surface properties, such as friction, wear resistance, chemical stability and lubricant compatibility.

New, lighter-weight powertrain materials fall into two general categories: (1) light-weight metals such as titanium, magnesium, aluminum, and titanium-, magnesium- and aluminum-based alloys; and (2) ceramics such as silicon-carbide and silicon-nitride. While all of these are strong, light, and fatigue resistant, each suffers from one or more failings in the powertrain application. For example, the light metals and their alloys tend to exhibit poor wear resistance and may fail catastrophically in an oil starved operating condition. In turn, ceramics cannot be cast or easily machined to net shape, and so are difficult to form to their final shape with high accuracy at low cost. Furthermore, some ceramics may not be compatible with current lubricant formulations and are subject to rapid wear in sliding contact.

Illustrative is EP 435 312 Al (published Jul. 3, 1991) which discloses a hard and lubricous thin film of amorphous carbon-hydrogen-silicon and a process for producing the film, which involves heating the component (hereafter sometimes referred to as the "substrate") to 600° C. in a vacuum. The disclosed film was applied to an iron-based (ferrous) material, resulting in a hard coating with low friction. However, such temperatures are incompatible with most substrates of interest, which lose desirable properties, soften, or even melt at such temperatures. Another approach, disclosed in U.S. Pat. No. 4,909,198 which issued on Mar. 20, 1990 has been to spray a thick (100–200 microns) iron or steel film which imparts the friction properties of conventional iron engine materials to an aluminum alloy component. That method may result in an engineered surface equivalent to that of current iron and steel materials, but is intrinsically incapable of providing a superior surface.

SUMMARY OF THE INVNETION

Against this background, it would be desirable to separately optimize bulk and surface properties, fabricating the component from a material with satisfactory bulk properties, and then "surface engineering" the appropriate surfaces of the component. This objective is achieved by applying a coating system which imparts the desired surface properties without significantly distorting the net shape of the component. For example, a light and easily machined aluminum-alloy component may be endowed with the wear resistance of the toughest ceramic by application of an appropriate coating. Also, a ceramic with desirable bulk properties but poor lubricant compatibility may be satisfactorily coated with a thin film designed to optimize lubrication.

Thus, the need has arisen for coating systems which are engineered to be highly adherent to the component material, are chemically stable, highly wear resistant, compatible with current and anticipated lubrication systems, and which exhibit low friction in dry sliding conditions.

Accordingly, the present invention discloses a powertrain component for use in an internal combustion engine and a method for applying a hard, wear resistant, lubricant-compatible coating which adheres firmly to the component. The present invention also discloses a powertrain component with an amorphous or nanocrystalline ceramic (AMC) film which, depending upon the specific application, significantly reduces friction and wear, and enhances lubricant compatibility. Also disclosed is an interlayer system for improving the adhesion and durability of the film to enable it to withstand mechanical stresses.

Optimal combinations of surface and bulk properties can be obtained by coating solid powertrain components fabricated of a material with desirable bulk properties with films which are characterized by the desired surface properties. Such bulk properties include high strength, low fatigue and light weight. The desired surface properties include hardness, wear resistance, low friction, lubricant compatibility and other chemical properties.

The present invention discloses physical vapor deposition (PVD by, for example, sputtering, thermal evaporation, or electron-beam evaporation) and chemical vapor deposition (CVD) of coating systems composed of various combinations of amorphous or nanocrystalline ceramic carbides, nitrides, silicides, borides and oxides, including but not limited to silicon nitride, boron nitride, boron carbide, silicon carbide, silicon dioxide, silicon oxy-nitride, silicon-aluminum-oxy-nitride, titania, and zirconia, and mixtures thereof.

The disclosed graded coating system may be deposited in a single deposition step by varying the composition of precursor vapors continuously (if a continuous composition profile is desired) or abruptly (if an abruptly varying composition profile is desired) in a deposition chamber.

Accordingly, an object of the present invention is to provide a ceramic-coated powertrain component for use in an internal combustion engine and a method for applying such a hard, wear resistant film which firmly adheres to the component.

Another object of the present invention is to provide a ceramic coating system having an interlayer between the ceramic film and the component, the interlayer serving to improve adherence of the film to the component by accommodating compressive or tensile stresses and avoiding problems of chemical incompatibility.

A further object of the present invention is to provide a satisfactory ceramic film-interlayersubstrate system having a graded or abruptly varying composition which can improve adherence, while providing additional mechanical support to a load-bearing surface.

The above-noted objects may be realized on powertrain and engine components other than on the valve actuation mechanism itself.

BEST MODES FOR CARRYING OUT THE INVENTION

Optimal combinations of surface and bulk qualities can be obtained by depositing a coating system upon solid powertrain components fabricated of a material with desirable bulk properties. Such coating systems include amorphous or nanocrystalline ceramic (AMC) films and interlayers which are characterized by the desired surface properties. Desired bulk properties include high strength, low fatigue, and light weight. Desired surface properties include wear resistance, low friction, lubricant compatibility, and other chemical properties.

The present invention discloses the deposition of coating systems composed of various combinations of amorphous or nanocrystalline silicon nitride, silicon carbide, silicon dioxide, silicon oxy-nitride, silicon-aluminum-oxy-nitride, titania, and zirconia and mixtures thereof.

Amorphous ceramic films are characterized by the absence of crystal structure, as evidenced by X-ray or electron diffraction techniques. Nanocrystalline ceramics are characterized by a small degree of short-range crystallographic order, with ordered domain sizes so small that a significant fraction of the atoms comprising each crystallite may be considered to be on its surface. Domain sizes are typically in the range of 20 to 500 Angstroms.

Because they are deposited at relatively low temperature, these films usually contain a fraction of hydrogen which may vary significantly with deposition conditions, and so may be referred to as "hydrogenated." For example, amorphous hydrogenated silicon-carbide may be alternatively designated a-SiC:H. For this disclosure, the simpler designation (e.g. SiC) will be used and the characteristics of amorphicity or nanocrystallinity, and optionally hydrogenation are implied.

Figure 4:
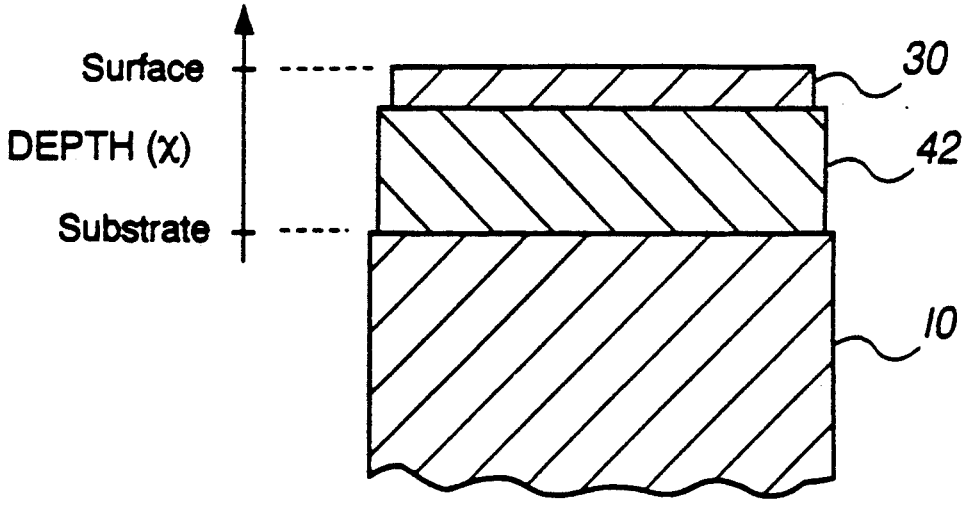
FIG. 4 is a schematic cross sectional view illustrating a component substrate and a coating system with a graded interlayer, and a low wear coating deposited thereupon.

The composition of such films can be varied continuously from the coating system-substrate interface, through the thickness of the coating system, to the surface, so as to optimize the properties of each, while assuring strong chemical bonding throughout the thickness of the film. A graded composition profile may result in a blurring of distinction between the interlayer 42 and the film 30 (FIG. 4).

The disclosed coating system may be deposited in a single deposition step by varying the composition of the precursor vapors and other conditions in the deposition chamber.

An illustrative example of the disclosed invention concerns the deposition of an AMC film on a lightweight powertrain component, such as a valve lifter. Details of an amorphous hydrogenated carbon film system on such components are described in copending, commonly assigned U.S. patent application Ser. No. 08/001,989, pending, filed on even date herewith by Pierre A. Willermet, Arup K. Gangopadhyay, Michael A. Tamor, and William C. Vassell entitled "POWERTRAIN COMPONENT WITH AMORPHOUS HYDROGENATED CARBON FILM," the disclosure which is hereby incorporated by reference herein.

Details of another coating system with a graded composition profile on such components are described in co-pending, commonl assigned U.S. patent application Ser. No. 08/002,490, pending, filed on even date herewith by Pierre A. Willermet, Arup K. Gangopadhyay, Michael A. Tamor, and William C. Vassell entitled "POWERTRAIN COMPONENT WITH ADHERENT FILM HAVING A GRADED COMPOSITION," the disclosure of which is hereby incorporated by reference.

Figure 1:
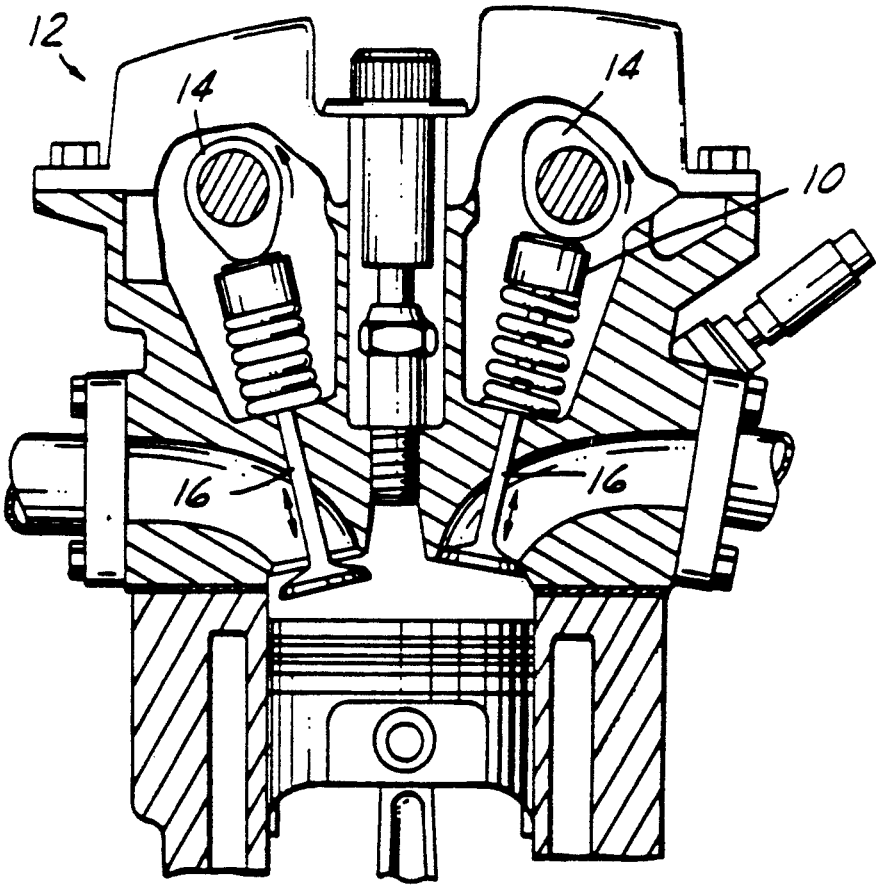
FIG. 1 is a schematic sectional view of an internal combustion engine including a valve lifter as illustrative of other powertrain components which exhibit the facets of the present invention.
Figure 2:
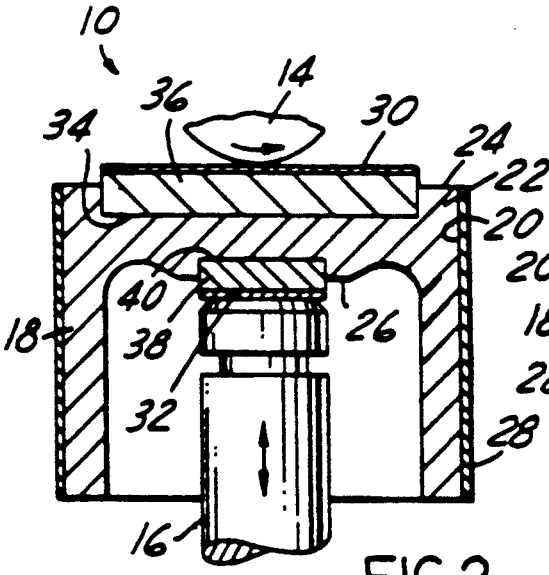
FIG. 2 is a schematic sectional view of a component fabricated according to the present invention.
Figure 3:
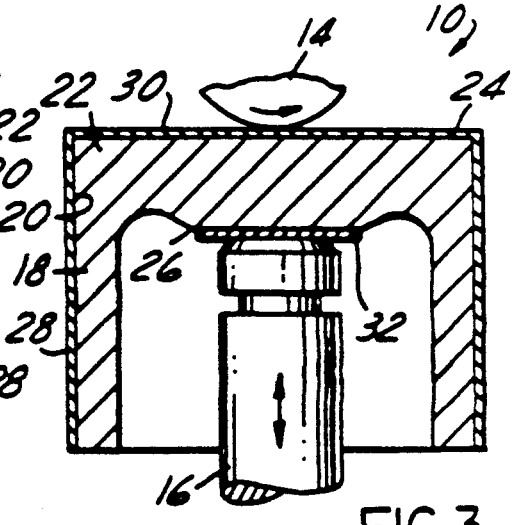
FIG. 3 is a schematic sectional view of an alternate embodiment of a component fabricated according to the present invention.

Turning now to FIGS. 1–3 of the drawings, there is depicted, as illustrative of other powertrain components, a valve lifter 10 for use in an internal combustion engine 12 under conditions which may or may not be oil-starved. Typically, the valve lifter is interposed between a cam 14 and a valve stem 16. Often, the valve lifter reciprocates within a guide channel formed within the cylinder head, between which frictional forces may be generated.

The valve lifter 10 has a hollow cylindrical body 18 with a continuous sidewall 20. At an upper end 22 of the sidewall 20 is a cam-facing surface 24 which cooperates with the cam 14. Disposed below the cam-facing surface 24 within the hollow cylindrical body 18 is a stem-facing surface 26 which cooperates with the valve stem 16. To impart the characteristics of low friction and wear resistance to the valve lifter 10, an AMC coating system 28 is formed on one or more wear surfaces, such as the sidewall 20 of the body 18.

As a result, the valve lifter 10 can be operated, even without effective lubrication in an oil-starved environment, for prolonged periods. Without such a coating, most valve lifters fail — especially in an oil-starved environment — if made of materials like aluminum, which characteristically exhibits poor wear resistance. Failure may result in seizure and welding.

Figure 5:
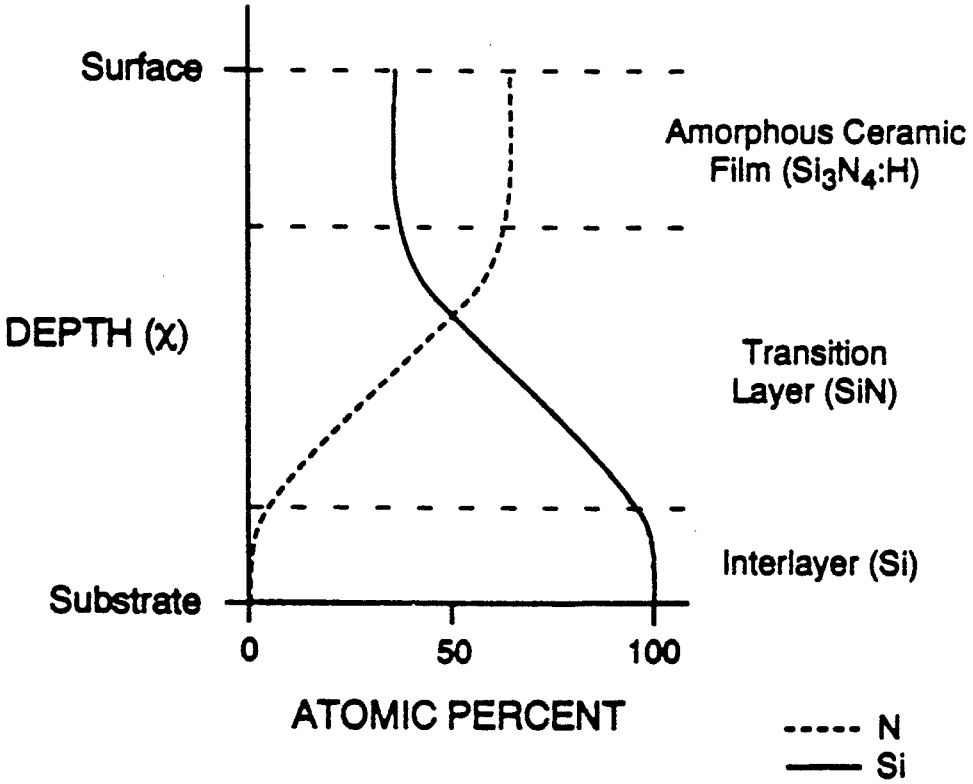
FIG. 5 is a graph illustrating a compositional profile of an exemplary Si-amorphous silicon nitride ceramic (AMC) graded layer coating system.

As depicted in FIGS. 4–5, the coating system includes an interlayer 42 formed between the film 30 and the substrate 10. The coating system may comprise a continuously or abruptly varying composition profile which enables surface engineering of a wide variety of film-interlayer-substrate systems to enhance friction, wear, and chemical compatibility. Additionally, such a graded interlayer permits simultaneous optimization of adhesion to the substrate, mechanical properties and stress state of the interlayer, and friction and wear properties of the surface.

Illustrative is an interlayer which is initially silicon close to the substrate 10, but gradually changes to harder and lubricant-compatible silicon nitride (FIG. 5). To optimize adhesion, the interlayer 42 may have a thickness of about 200 angstroms. Thicker interlayers, however, such as those primarily designed for supporting significant mechanical loads, may have a thickness of up to 30 microns.

Because the stress state of many of the disclosed coating systems can be controlled by careful selection of deposition conditions, any compressive stress engendered during formation of the AMC film of the desired structure and composition can be cancelled by tensile stress built into the interlayer beneath. This provides an advantage similar to that obtained in tempered glass: compression in the surface layer closes and so inhibits propagation of fractures which would lead to eventual delamination or disintegration of the coating system. Additionally, a thick, durable, low-stress coating system may be built by alternating tensile hard layers with compressive amorphous ceramic layers.

By careful choice of the compositional profile in the graded layer, film adhesion to certain substrate materials may be obtained in combination with surface properties which are optimized for low friction, low wear, hardness, and lubricant compatibility. Such substrates include aluminum, an aluminum-silicon alloy, an aluminum-copper-silicon alloy, steel and other ferrous alloys, magnesium, magnesium alloys, aluminum nitride, titanium, Ti-Al alloys, ceramics, and mixtures thereof. Ceramic components are well matched by intermediate compositions, which may even match the ceramic exactly. An additional advantage is the provision of high density ceramic coating systems for use in light weight components.

Another advantage of the graded layer technique disclosed herein is that it offers an engineering margin because once the outer layer is worn through, the desirable surface properties are lost only gradually. Catastrophic de-adhesion is suppressed.

Turning again to FIGS. 4–5, there is depicted an exemplary compositional profile for a silicon-silicon carbide-amorphous silicon nitride graded layer system. FIG. 4 schematically illustrates a powertrain component 10 which serves as a substrate for a graded interlayer 42, upon which is deposited a low wear coating 30.

FIG. 5 depicts the compositional changes of silicon and nitrogen with distance from the substrate 10. Close to the substrate 10, the amount of silicon is relatively high, and the amount of amorphous Si-N is correspondingly low. The converse is true in regions close to the outer surface S of the coating 30.

It will thus be apparent that the disclosed coating system may include a composition gradient such that the outside surface of the coating system includes a film which predominantly comprises a first group consisting of amorphous or nanocrystalline silicon nitride, silicon carbide, silicon dioxide, silicon oxy-nitride, silicon-aluminum-oxy-nitride, titania, and zirconia and mixtures thereof. Intermediate portions of the coating system comprise an interlayer which predominantly includes a constituent selected from a second group consisting of silicon, silicon carbide, silicon nitride, boron nitride, and mixtures thereof. The proportion of the constituent selected from the second group increases with proximity to the substrate.

Alternatively, the interlayer, the film, or both may embody the composition gradient or profile. Within each member of the coating system, the composition profile may vary continuously, or abruptly.

Preferably, where the substrate is of a relatively soft material, such as aluminum, the interlayer should be relatively thick (exceeding 1 micron). The provision of a relatively thick silicon interlayer serves to improve adhesion and durability of low-wear coatings (having a thickness for example of about 1.5 microns) on mechanical components which are subject to sliding contact, rolling contact, or both. As noted earlier, depending on the substrate material and component operating conditions, the interlayer may have a thickness between 200 angstroms (mainly for adhesion) and 30 microns (mainly for additional mechanical support).

Sputtered or vapor-deposited amorphous silicon is ideal and is preferable for use as a thick interlayer because its hardness approaches that of ceramics and it is chemically compatible with many film coatings and substrate materials, such as steel and other ferrous materials, titanium, magnesium, aluminum, Ti-Al, Al-N, SiC, SiN, and other ceramics. Additionally, silicon also assures excellent adhesion and is readily deposited at high rates by a variety of chemical and physical vapor deposition methods.

The effectiveness of the AMC system has been demonstrated in laboratory tests. A disk of siliconaluminum alloy (11.6% Si; Cu 4.0%; Fe 0.4%; Mg 0.64%; Ti 0.05%; balance Al) was first coated with a layer of sputtered silicon 1.5 microns thick, and then with a plasma-deposited (CVD) amorphous silicon-nitride film 0.4 microns thick. The friction and wear of a steel ball sliding on the disk was measured in a pin-on-disk tribotesting apparatus. The coating system was found to be fully lubricated by conventional engine oils, and exhibited extremely low surface deformation and wear rate, despite the relative softness of the aluminum substrate.

Figure 6:
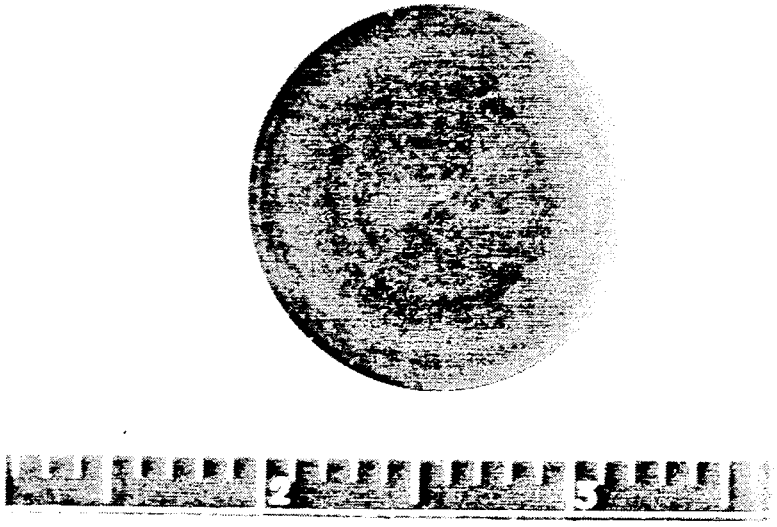
FIG. 6 is an optical micrograph showing a coating system with a silicon interlayer and a Si-N film on an aluminum silicon alloy substrate.

Turning now to FIG. 6, an optical micrograph depicts the disclosed coating system. That figure shows a tappet insert made of the aluminum-11.6% silicon alloy discussed above. The insert was first coated with a 4.8 micron thick silicon layer followed by a 0.5 micron Si-N layer. The interlayer was deposited by a sputtering (PVD) technique. After sputtering, the sepcimen was removed from the deposition chamber and the Si-N layer was deposited by CVD in a separate deposition chamber. The primary purpose of the silicon interlayer was to improve adhesion and reduce plastic deformation of the substrate.

A preferred method of depositing the disclosed coating systems is by combinations of plasmaenhanced chemical vapor deposition (PE-CVD) and sputtering. Mono-elemental layers, such as metals or an amorphous silicon interlayer as described earlier, are most readily deposited by sputtering. Sputter deposition of ceramic compounds is possible, but may result in a mechanically weak coating. The inventors have found that the reactive chemistry of radio-frequency (RF) low-pressure PE-CVD is best suited to deposition of ceramic coatings for mechanical applications.

Figure 7:
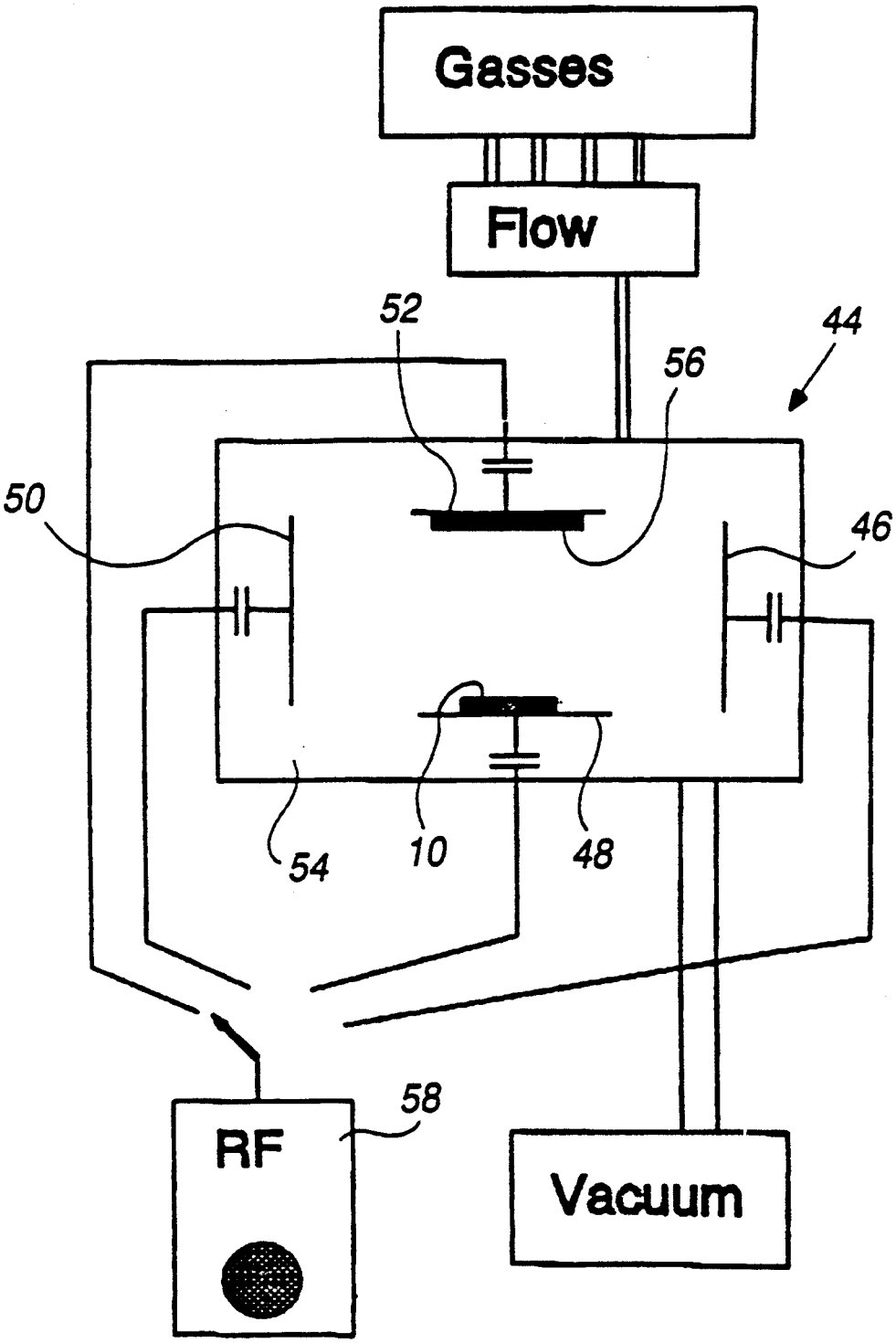
FIG. 7 is a diagram of the apparatus used to prepare the disclosed coating systems.

A very flexible coating system is prepared in the tetrode-reactor 44 illustrated in FIG. 7. This system consists of forming electrode plates 46, 48, 50, 52 arranged in a vacuum chamber 54. The substrate 10 (the component) is fixed to one 48 of the four electrodes, and the material 56 to be sputtered if so desired is affixed to the electrode 52 opposite.

RF power 58 may be directed to any combination of the four electrodes: (1) to the electrode 52 opposite the substrate (the sputter target) for sputter deposition; (2) to the substrate electrode 48 for biased PE-CVD, for which the substrate electrode acquires a negative potential relative to the plasma; and (3) to the two transverse electrodes 46, 50 for unbiased PE-CVD where a reactive plasma is generated, but only a small potential appears at the substrate 10.

The substrate 10 may also be heated or cooled, or electrically biased to a constant DC bias potential to further modify properties of the deposit. For example, ion bombardment associated with a large negative potential, whether from self-bias or external bias, tends to increase film density and strength, and may also increase compressive stress. Ion bombardment and high substrate temperature both may provide energy for local atomic rearrangements in the growing film and so tend to promote local order in the otherwise amorphous material. Thus, the degree of nanocrystallization may also be controlled through temperature and ion bombardment. This nascent ordering is usually accompanied by the appearance of tensile stress. Additionally, compressive stress is generally increased by reduction of the RF excitation frequency to 100 kilohertz from the usual approximately 12–13 megahertz. Stress can also be controlled by control of film stoichiometry. For example, excess silicon in $Si_3N_4$ results in tensile stress. Correspondingly, crystallization may be suppressed even in the presence of strong ion bombardment by maintaining a low substrate temperature.

It should be noted that although the deposition methods for these materials are often derived from those developed for electronics applications, where electronic properties are paramount, the conditions used for mechanical coatings are optimized for mechanical properties at maximal deposition rates, and may result in poor electronic properties.

The vapor precursors for chemical vapor deposition of ceramics may be selected from a very wide choice and depend upon the desired film composition. For example, some typical choices for CVD deposited ceramics are: (1) silane ($SiH_4$) and ammonia ($NH_3$) for silicon-nitride ($Si_3N_4$), (2) silane and methane ($CH_4$) for silicon-carbide (SiC), (3) silane and oxygen or preferably nitrous oxide ($N_2O$) for silica ($SiO_2$), (4) methane and diborane ($B_2H_4$) for boron carbide ($B_4C$) and (5) diborane and ammonia for boron nitride (BN). To increase chemical reactivity and reduce hydrogen content, chlorinated and fluorinated precursors (e.g. $SiCl_3H$, $SiF_4$, $BCl_3$. . . ) may be substituted. Certain compositions include some elements which are unavailable in a vapor form which is suitable and safe for production purposes (e.g. W, Ti, Hf, Zr). Such ingredients may be provided by sputtering from a solid source (target) of the appropriate composition directly into the reacting plasma. Under certain conditions, the sputtered elements react in the plasma, rather than traverse the plasma directly to the substrate. This process is also known as reactive sputtering.

One deposition process consists of the following steps. The substrate (component) 10 is cleaned with a commercially available detergent and organic solvent and fixed to the substrate electrode 48 in the vacuum chamber 54. The chamber 54 is evacuated to below 1 micro-Torr to remove all water vapor which may disturb the chemical composition of the film. The substrate is sputter-cleaned by introducing inert gas, such as argon, to a pressure of 1 to 100 milli-Torr and directing RF-power 58 to the substrate electrode 48. Argon ions are drawn down through the electrical potential difference which appears between the plasma and the now self-biased electrode 48, and bombard the substrate 10, thereby dislodging contaminants and actually etching (albeit at a very low rate) the substrate 10.

Deposition of the amorphous ceramic is begun by introducing the appropriate mixture of precursors as the flow of inert gas is stopped, while continuing lowed to extinguish. As the gas mixture changes from etching to depositing, an atomically mixed interfacial transition layer is formed, assuring good adhesion. This continuous change-over keeps the growth surface very clean at all times.

If strong ion bombardment is desirable, film deposition may be continued in this mode until the desired thickness is achieved. Otherwise, RF power can be gradually directed to the two transverse electrodes 46, 50, which sustains the reactive plasma while reducing the potential between the substrate 10 and the plasma. If a continuously or abruptly varying film composition is desired, the precursor mixture may be gradually or abruptly changed as appropriate.

If a sputtered interlayer is desired, it may be deposited between the sputter-cleaning and AMC deposition steps by continuing the flow of inert gas and gradually redirecting RF power from the substrate electrode 48 to the target electrode 52 (the opposing electrode), again without interrupting the plasma. This sputters material from the target 56 for deposition on the substrate 10. When the desired interlayer thickness is reached, RF power is redirected to the substrate 10 and AMC film growth is resumed.

In one experiment, a silicon nitride film is deposited by plasma enhanced chemical vapor deposition (PECVD). The deposition is carried out in a parallel plate RF plasma deposition system operating at 13 MHz using 2% silane-in-nitrogen and ammonia as the reactant gases. The reaction chamber is kept at a pressure of 350 mTorr to maximize the film uniformity. A low RF power is typically used for improved film density, preferably 35 W with a 10" diameter electrode. The specimen is heated at 300° C. during the deposition to minimize the hydrogen content of the film. To improve adhesion of the nitride layer to the substrate, prior to the deposition, the specimen is cleaned in situ using a 50 W RF discharge at 350 mTorr pressure of 50% ammonia in nitrogen. For purposes of this test, the thickness of the film is kept between 5000 to 8000 Angstroms. The refractive index of the film, measured using a silicon substrate test sample, is found to be between 2.00 and 2.03 which is in good agreement with the value expected for stoichiometric silicon nitride.

For many applications, the interlayer may be formed from silicon. It should be realized, however, that in some environments, the deployment of an interlayer of aluminum, germanium, or elements selected from columns IVB, VB, or VIB of the periodic table, may be made with good results. In general, the selection of a suitable interlayer tends to be guided by availability of an interlayer material which tends not to be water soluble and exhibits good stability as a carbide, nitride, boride, oxide or silicide, as appropriate.

The disclosed films may be usefully applied to various components, such as engine and journal bearings, besides a valve stem and a valve guide. Other applications include the use of nanocrystalline or ceramic films at the piston-cylinder interface, and on swash plates used in compressors.

Accordingly, there has been provided in accordance with the present invention an improved powertrain component and its method of preparation. The component includes one or more AMC coating systems of films and interlayers having a composition profile which impart the characteristics of low friction and wear resistance to the component. As a result, the average service intervals required by the component tend to be prolonged and therefore less frequent.

We claim:

1. A powertrain component in an internal combustion engine, the powertrain component comprsing:

a coating system including a film and an interlayer;

the film being selected from a first group comprising at least one of amorphous or nanocrystalline silicon nitride, silicon carbide, silicon dioxide, silicon oxynitride, silicon-aluminum-oxy-nitride, titania, and zirconia, the film being formed on the powertrain component, the film imparting the characteristics of low friction and wear resistance to the component;

the interlayer being formed between the film and the component, the interlayer accommodating stresses engendered by formation of the film, providing mechanical support to the film, and chemical compatibility between the film and the substrate, thereby improving adherence of the film to the substrate.

2. The powertrain component of claim 1, wherein the interlayer comprises:

a constituent selected from a second group copmrsing at least one of silicon, silicon carbide, silicon nitride, and boron nitride.

3. The pwertrain component of claim 2, wherein the coating system includes:

a composiiton profile such that an outside surface of the coating system predominantly includes a member of the first group.

intermediate portions of the coating system predominantly including a constituent selected from the second group, the proportion of the constituent increasing with proximity to the substrate.

4. The powertrain component of claim 2, wherein the film includes:

a composition profile such that an outside surface of the film predominantly includes a member of the first group, intermediate portions of the film predominantly including a constituent selected from the second group, the proportion of the constituent increasing with proximity to the interlayer.

5. The powertrain component of claim 2, wherein the interlayer includes:

a composition profile such that a film-facing surface of the interlayer predominantly includes a member of the first group, intermediate portions of the interlayer predominantly including a constituent selected from the second group, the proportion of the constituent increasing with proximity to the substrate.

6. The powertrain component of claim 1, wherein the interlayer has a thickness between 200 angstroms and 30 microns.

7. The powertrain component of claim 1, wherein the film is deposited in a state of compressive stress; and the interlayer is deposited in the state of tensile stress, such that the net stress of the coating system is effectively neutralized.

8. The powertrain component of claim 1, wherein the film includes alternating layers with compressive and tensile stress achieved by variations in deposition conditions during film growth, such that the film exhibits a state of reduced net stress.

9. The powertrain component of claim 1, wherein the interlayer includes alternating layers with compressive and tensile stress achieved by variations in deposition conditions during interlayer growth, such that the interlayer exhibits a state of reduced net stress.

10. The powertrain component of claim 3, wherein the composition profile continuously varies between the outside surface of the coating system and a component-facing portion thereof.

11. The powertrain component of claim 3, wherein the coating system includes a composition profile having an abruptly varying composition.

12. The powertrain component of claim 4, wherein the composition profile continuously varies between the outside surface of the film and an interlayer-facing portion thereof.

13. The powertrain component of claim 4, wherein the film includes a composition profile having an abruptly varying composition.

14. The powertrain component of claim 5, wherein the composiiotn profile continuously varies between the film-facing surface of the interlayer and a component-facing portion thereof.

15. The powertrain component of claim 5, wherein the interlayer includes a composiiotn profile having an abruptly varying composition.

16. The powertrain component of claim 4, wherein the composiiotn profile includes alternating layers of compositions selected from the first and second groups, the thickness of the layers of the first group increasing, and the thickness of the layers of the second group decreasing with distance from the substratecoating interface.

17. An internal combustion engien having a powertrain componment having:

a coating system including a film and an interlayer;

the film being selected from a first group comprising at least one of amorphous or nanocrystalline silicon nitride, silicon carbide, silicon dioxide, silicon oxynitride, silicon-aluminum-oxy-nitride, titania, and zirconia, and the film being formed on the powertrain compoent, the film imparting the chaacteristics of low friction and wear resistance to the component;

the interlayer being formed between the film and the component, the interlayer accommodating stresses engendered by formation of the iflm, thereby providing mechanical support to the film, and chemical compatbiblity between the film and the substrate, thereby improving adherence of the iflm to the substrate.

18. The powertrain compnent of claim 17, wherein the interlayer comprises:

a constituent selected from a second group cormpsing at least one of silicon, silicon carbide, silicon nitride, and boron nitride.

* * * * *